United States Patent [19]

Brine, III et al.

[11] Patent Number: 5,037,112

[45] Date of Patent: Aug. 6, 1991

[54] LACROSSE STICK HEAD

[75] Inventors: William H. Brine, III, Mendon, Mass.; Peter J. Brine, Hanover, N.H.

[73] Assignee: Sports Licensing, Inc., Hanover, N.H.

[21] Appl. No.: 627,318

[22] Filed: Dec. 14, 1990

[51] Int. Cl.[5] ..... A63B 59/02

[52] U.S. Cl. ..... 273/326

[58] Field of Search ..... 273/326

[56] References Cited

U.S. PATENT DOCUMENTS

| | | | |
|---|---|---|---|
| D. 236,737 | 9/1975 | Brine | D34/5 CB |
| D. 248,679 | 7/1978 | Rule | D34/5 CT |
| D. 263,248 | 3/1982 | Brine | D21/210 |
| D. 286,666 | 11/1986 | Brine | D21/210 |
| 4,034,984 | 7/1977 | Crawford et al. | 273/326 |
| 4,138,111 | 2/1979 | Rule | 273/326 |
| 4,270,756 | 6/1981 | Ahlemfeld et al. | 273/326 |
| 4,657,260 | 4/1987 | Brine | 273/326 |

*Primary Examiner*—William H. Grieb

*Attorney, Agent, or Firm*—Lorusso & Loud

[57] ABSTRACT

A lacrosse stick head comprising a frame and netting attached to the frame, the frame including a pair of side walls and a lip portion joined to ends of the side walls, upper edges of the side walls defining an upper edge plane; the lip portion comprising a wall having a centerline plane intersecting the side wall upper edge plane at an acute angle, the lip portion wall having an upper edge midpoint removed from the side wall upper edge plane, and segments of the lip portion wall between the lip portion midpoint and the side walls being curved.

4 Claims, 6 Drawing Sheets

LACROSSE STICK HEAD

BACKGROUND OF THE INVENTION

1. Field of the Invention

The invention relates to lacrosse stick heads and is directed more particularly to a lacrosse stick head having an improved lip portion structure.

2. Description of the Prior Art

Lacrosse sticks generally are well known in the art and typically comprise a head frame including a throat portion, at which a stick handle is affixed to the head, and a pair of side walls extending from the throat portion and joined to a lip portion. Netting is supported by the frame and defines a ball pocket.

As the game of lacrosse has progressed and quickened, the art of passing the ball and shooting for goal has become one of great finesse, as well as time-honored power and determination. In recent times, passes and shots on goal have become in many instances wrist-flicking motions, rather than full stick swings, as in previous eras. In U.S. patent application Ser. No. 07/628,193, filed Dec. 14, 1990, in the names of Joseph Taylor, William H. Brine, III and Peter J. Brine, there is shown a lacrosse stick head in which the ball pocket is located forwardly of the throat, rather than in the more traditional throat area, to position the ball for finesse shooting and passing. The head having the advanced position pocket is shown in this application for illustrative purposes, though the invention herein finds facility in the more traditional heads, as well.

Heretofore, it has been customary for the lip portion of the head frame to comprise a wall having a more pronounced slant than the side walls and throat wall of the frame, to permit the ball readily to roll thereover in passage from the netting to flight. The upper edge of the lip portion wall frequently is a continuation of the upper edge of the side walls and in substantially the same plane. In some cases, there is a slight dip in the lip wall upper edge, particularly around the mid-point thereof. In the side-to-side dimension, the lip walls have been straight or slightly curved.

It has been found that to improve a lacrosse stick head for passing and shooting, it is beneficial to have the lip wall at a substantial angle of inclination, relative to the side walls, and to have the upper edge of the lip wall substantially below the plane of the upper edges of the side walls, and further to have in the side-to-side dimension, the lip wall were pronouncedly rounded. All of these factors serve to place the lip end of the head in a generally U-shaped configuration so as to provide an opening in alignment with the ball pocket, whether in the throat or at an advanced position, and generally nearer the level of the ball pocket. Such an arrangement provides, in effect, a conduit for the ball, leading from the netting to flight.

SUMMARY OF THE INVENTION

It is, therefore, an object of the invention to provide a lacrosse stick head having an improved lip wall disposed at a pronounced angle of inclination relative to a side wall top edge plane.

A further object of the invention is to provide such a lip wall in which the lip wall upper edge mid-point is well removed from the side wall upper-edge plane.

A still further object of the invention is to provide such a lip wall in which segments of the wall between the lip wall mid-point and the side walls are curved to provide a generally U-shaped opening at the lip end of the head.

With the above and other objects in view, as will hereinafter appear, a feature of the present invention is the provision of a lacrosse stick head comprising a frame and netting attached to the frame, the frame comprising a throat portion, side walls extending from the throat portion and diverging from each other, and a lip portion joined to ends of the side walls remote from the throat portion to form a lip end of the head, upper edges of the side walls defining an upper edge plane, the lip portion comprising a wall having a centerline plane intersecting the side wall upper edge plane at an angle of about 35–55°, the lip portion wall having an upper edge midpoint removed from the side wall upper edge plane by about 0.65–2.65 inch, and segments of the lip portion wall between the lip portion midpoint and the side walls being curved, whereby to provide a generally U-shaped structure for the lip portion and thereby a generally U-shaped opening at the lip end of the head.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENT

Figure 1:
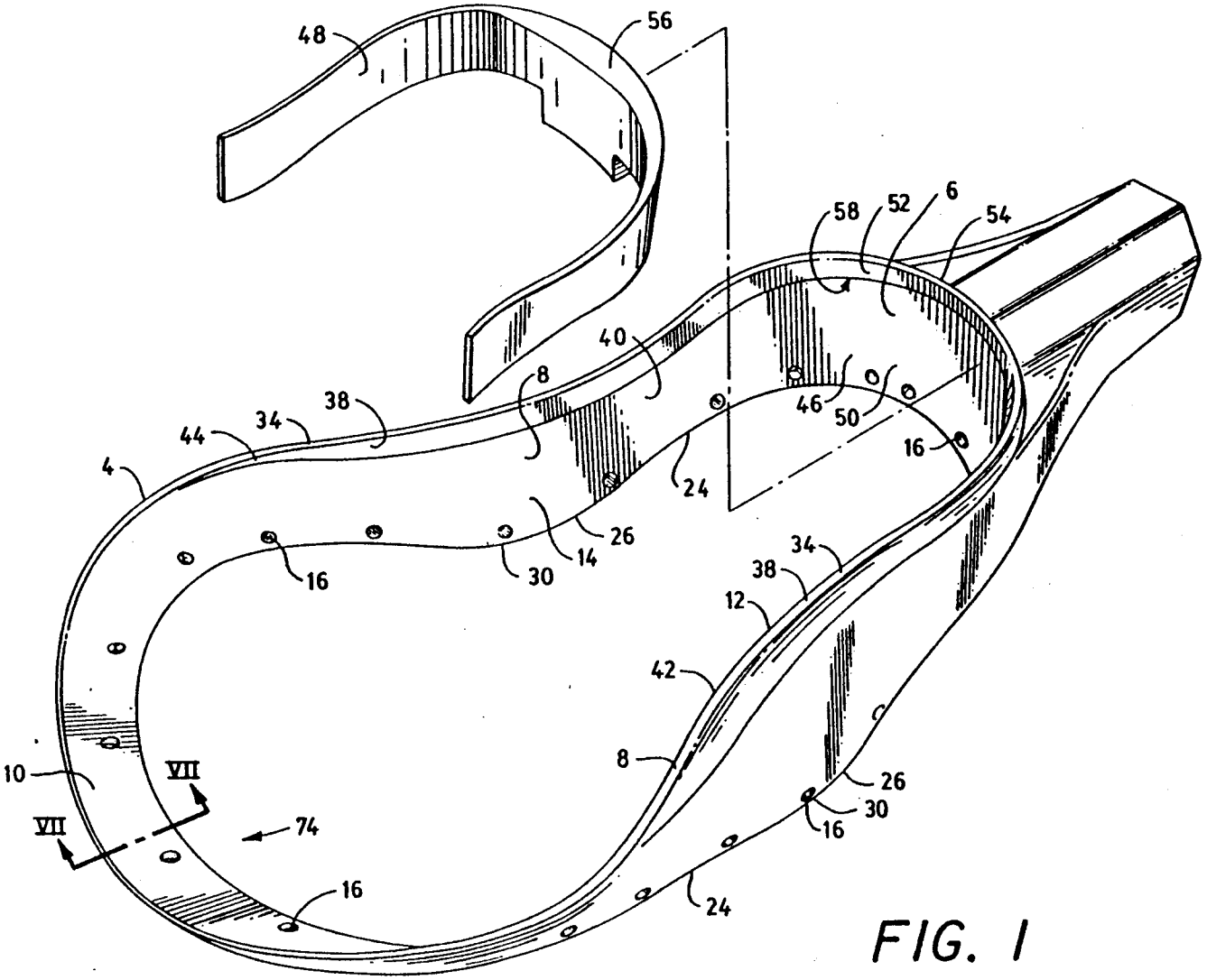
FIG. 1 is a perspective view of one form of lacrosse stick head, less netting, illustrative of an embodiment of the invention.

Referring to the drawings, it will be seen that an illustrative lacrosse stick includes a head portion 2 adapted to be connected to a stick handle (not shown). The head portion 2 comprises a frame 4 which includes a throat portion 6 from which extend side wall means 8. A distal end of the side wall means 8 joins a lip portion 10. The side wall means 8 generally include two side walls 12, 14, as illustrated in FIG. 1, but may comprise only one side wall. The frame 4 may be of wood, but in recent times has generally been constructed of a substantially rigid light-weight plastic, such as a nylon, a polyurethane, or mixtures of thermoplastic polymers.

The throat portion 6, the side wall means 8 and the lip portion 10 are provided with holes 16 in which are disposed portions 18, 20, respectively, of a netting 22. The netting 22 is thus attached to, and retained by, the frame 4.

Figure 6:
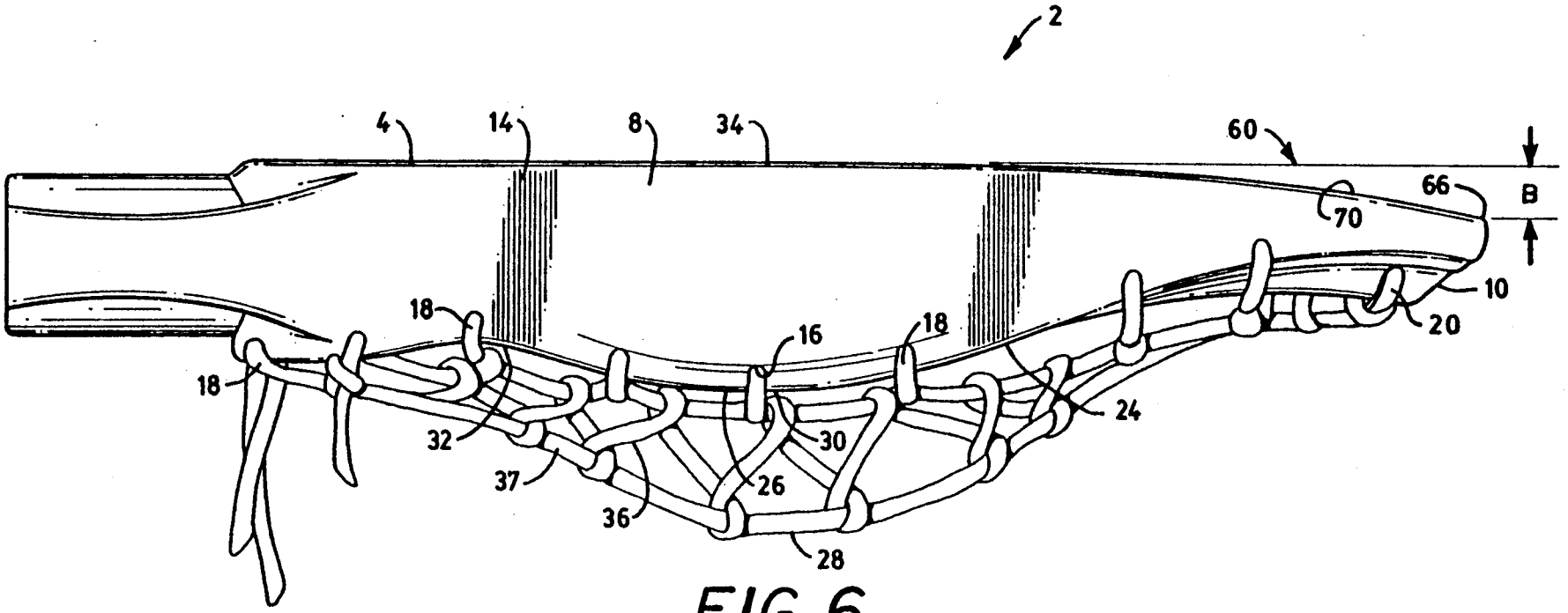
FIG. 6 is a side elevational view of the lacrosse stick head shown in FIG. 2.

Referring to FIG. 6, it will be seen that the side wall means 8 is characterized by a bottom edge thereof 24 which extends outwardly, edgewise, such as generally to define a bulge 26 in the bottom of the side wall means. The bulge 26 comprises an outward extension of the bottom edge 24, the bulge being substantially in the plane of the side wall. The holes 16 in the side wall means 8 are each disposed proximate the bottom edge 24, enabling the netting to define a ball pocket 28 (FIGS. 4 and 6) generally alongside and beneath the bulge 26, which is disposed about mid-length of the side wall means.

Figure 4:
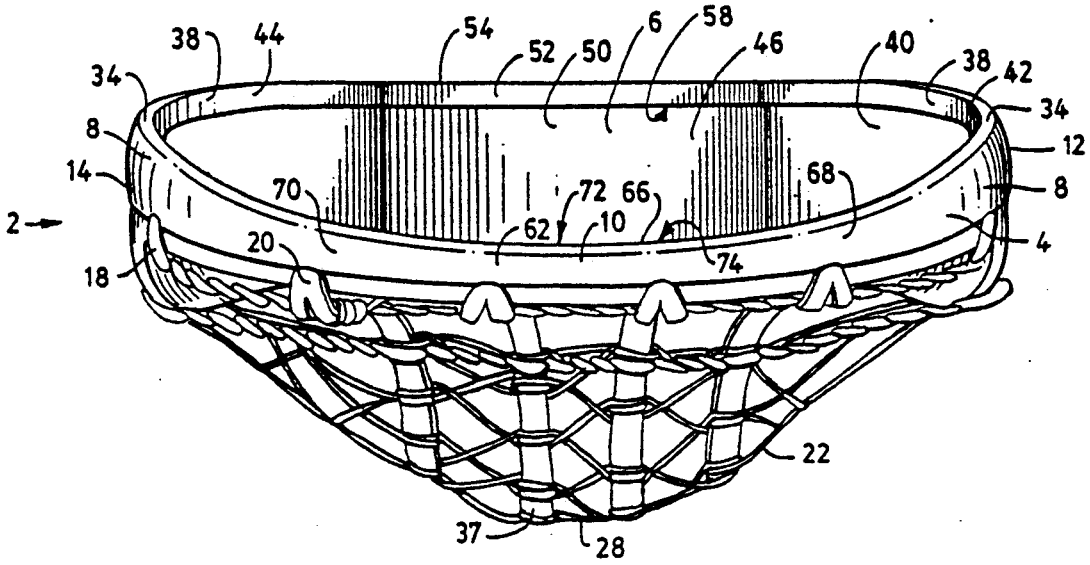
FIG. 4 is a lip end view of the lacrosse stick head shown in FIGS. 2 and 3.
Figure 5:
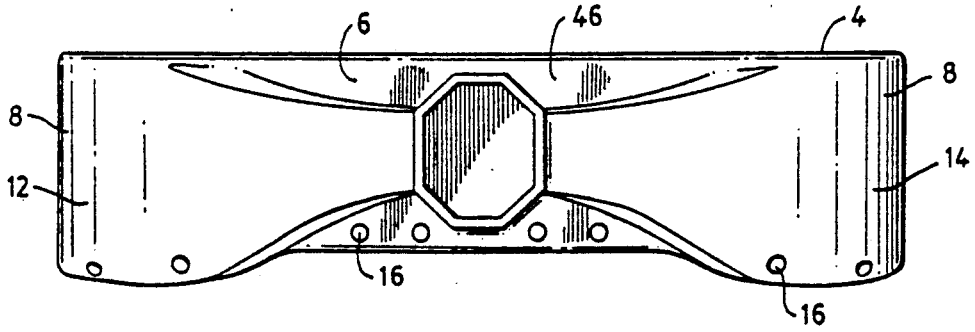
FIG. 5 is a rear elevational view of the lacrosse stick head shown in FIG. 1.

The bulge 26 at its midpoint 30 (FIG. 6) is about 1.15–1.5 times the height of the side wall means at a throat end 32 (FIG. 6) of the bulge. Widthwise strands 36 and lengthwise strands 37 of the netting 22 are configured so as to define the ball pocket 28 widthwise of the head 2 in a substantially centered location (FIG. 4).

Thus, there is provided a lacrosse stick head having a ball pocket spaced from the throat area of the head and closer to the lip portion, but also spaced from the lip portion, as well as the side wall means. This feature is described and shown in the aforementioned U.S. patent application, Ser. No. 07/628,193.

Figure 2:
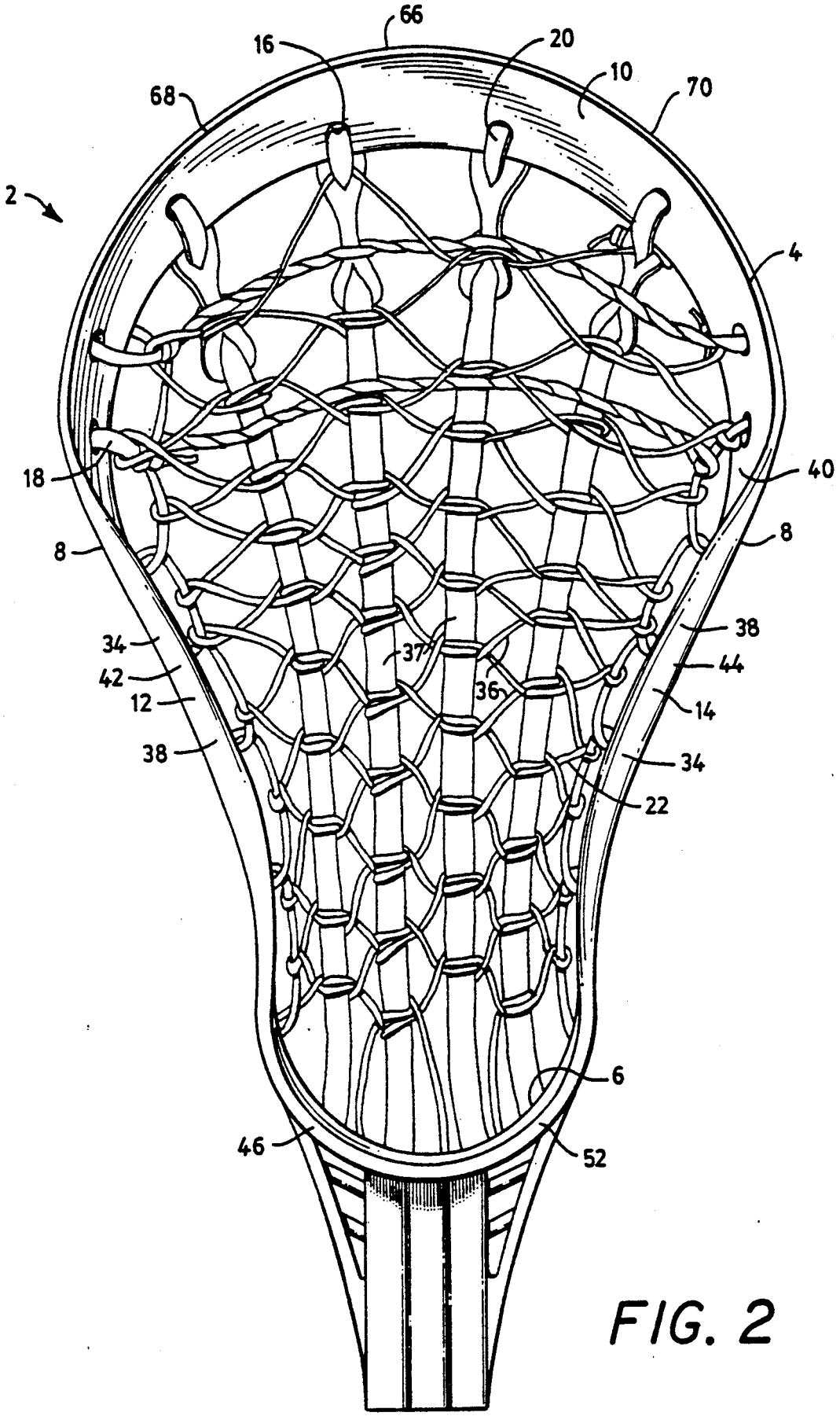
FIG. 2 is a top plan view of the lacrosse stick head shown in FIG. 1 but with netting.
Figure 3:
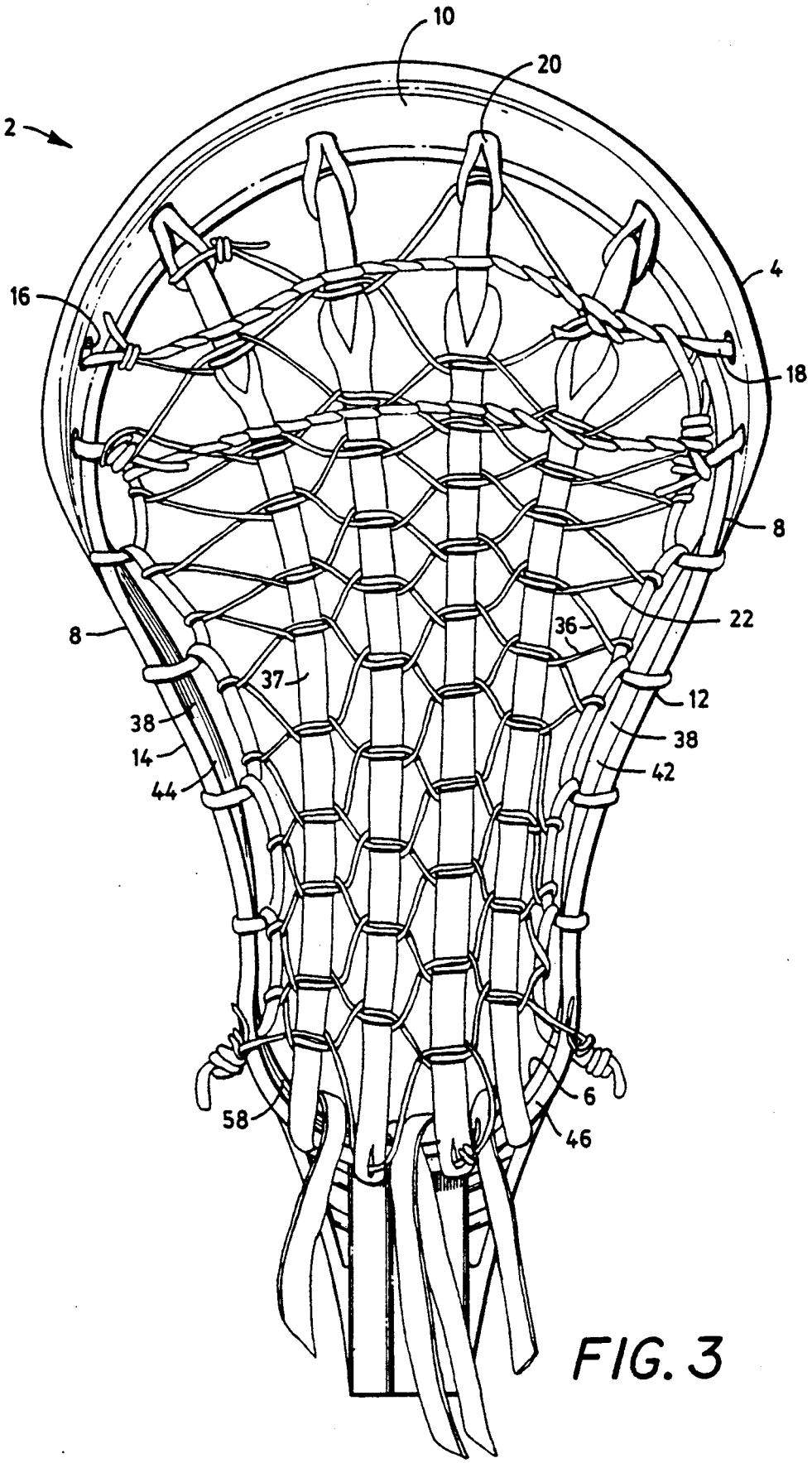
FIG. 3 is a bottom view of the lacrosse stick head shown in FIG. 2.

Each side wall 12, 14 of the side wall means 8 is provided with elongated rib means 38 on an interior surface 40 of the side wall and extending inwardly so as to overlie marginal portions of the netting. Preferably, the rib means is disposed, at least in part, proximate the upper edge 34 of the side wall, as may be seen in FIGS. 1 and 2. In the embodiments in which the side wall means 8 comprise the two side walls 12, 14, the rib means 38 comprise first and second rib means 42, 44 extending inwardly of the frame toward each other in a plane overlying the ball pocket 28, and overlying portions of the netting proximate the ball pocket 28. The rib means 42, 44 each comprise protrusions extending from the substantially planar interior surfaces 40 of their respective walls, and substantially normal to the interior surfaces. Preferably, the rib means 38 are molded integrally with the side wall means 8.

There is thus provided a lacrosse stick head frame in which the side wall means are given added rigidity by rib means, the rib means being disposed interiorly of the side wall means, leaving the exterior free for cosmetic purposes, and the rib means providing a head having a centrally located ball pocket with a ball retention aid by virtue of overlying netting in the vicinity of the ball pocket. This feature is shown and described in U.S. patent application Ser. No. 07/628,419, filed Dec. 14, 1990, in the names of William H. Brine, III and Peter J. Brine.

As may be seen in FIGS. 1–4, the two side walls 12, 14 converge into a throat wall 46, which has attached thereto a relatively soft and spongy ball stop member 48 (FIG. 1). against which a ball (not shown) may lie, when carried by an operator, in the throat portion 6 of the head and which may act to stop a ball passed from another player to the operator. The ball stop member 48 typically is provided with a tacky surface and during assembly of the stick in manufacture, or after purchase by an operator, the tacky surface is applied to an interior surface 50 (FIGS. 1 and 4) of the throat wall, whereby to secure the ball stop member 48 to the throat wall 46.

The throat wall 46 may be provided with rib means 52 extending from the interior surface 50 of the throat wall 46. The rib means 52, which comprises a flange-like protrusion extending from the interior surface 50 of the throat wall 46 and substantially normal thereto, serves to add rigidity to the frame. Further, the rib means 52 is disposed proximate an upper edge 54 of the throat wall to serve as a guide for the proper placement of the ball stop member 48 by simply placing an upper edge 56 (FIG. 1) of the ball stop member against an undersurface 58 of the rib means 52. Upon completion of the ball stop member attaching step, the upper edge 56 of the ball stop member is concealed by underlying the rib means 52. This feature is shown and described in U.S. patent application Ser. No. 07/628,419, filed Dec. 14, 1990, in the names of William H. Brine, III and Peter J. Brine.

As noted above, the frame portion, including the throat walls, of most present-day lacrosse sticks are of molded plastic. It is preferable that the rib means 52 be molded integrally with the frame. As illustrated in the drawings, the throat wall rib means 52 may extend to the side wall rib means 38 and form a continuation of the side wall rib means.

Figure 7:
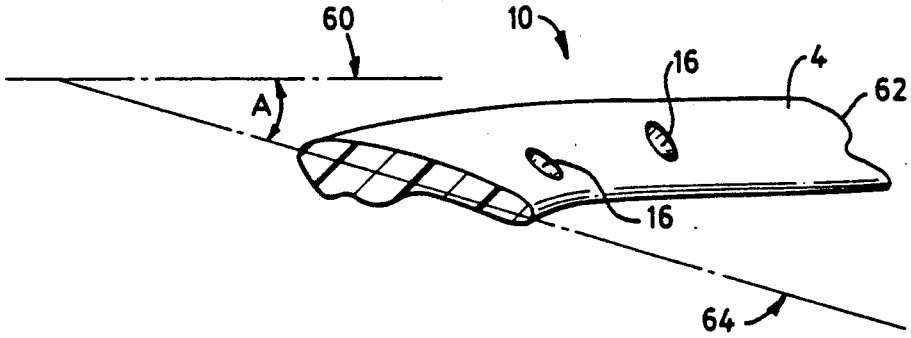
FIG. 7 is a sectional view taken along line VII—VII of FIG. 1.

Referring again to FIG. 6, it will be seen that in accordance with the present invention, the frame side wall upper edges 34 define an upper edge plane 60. The lip portion 10, forming the lip end of the lacrosse stick head, comprises a lip wall 62 (FIG. 7) having a centerline plane 64 intersecting the side wall upper edge plane 60 at an angle A of about 35–55°, preferably around 41°. The lip wall 62 has an upper edge midpoint 66 removed from the side wall upper edge plane 60 by a distance B of about 0.65–2.65 inch, preferably about 0.67 inch. Segments 68, 70 (FIG. 4) of the lip wall 62 between the lip wall midpoint 66 and the side walls 12, 14, respectively, are pronouncedly curved to provide a generally U-shaped structure 72 for the lip portion 10, and thereby a generally U-shaped opening 74 at the lip end of the head.

There is thus provided an opening in the lip end of the head which is structured and configured to serve as a conduit for the ball, from ball pocket to flight, which contributes to greater dexterity, finesse and accuracy in passing and shooting on goal.

It is to be understood that the present invention is by no means limited to the particular construction herein disclosed and/or shown in the drawings, but also comprises any modifications or equivalents within the scope of the claims.

Having thus described our invention, what we claim as new and desire to secure by Letters Patent of the United States is:

1. A lacrosse stick head comprising a frame and netting attached to said frame, said frame comprising a throat portion, side walls extending from said throat portion and diverging from each other, and a lip portion joined to ends of said side walls remote from said throat portion to form a lip end of said head, upper edges of said side walls defining an upper edge plane, said lip portion comprising a wall having a centerline plane intersecting said side wall upper edge plane at an angle of about 35–55°, said lip portion wall having an upper edge midpoint removed from said side wall upper edge plane by about 0.65–2.65 inch, and segments of said lip portion wall between said lip portion midpoint and said side walls being curved, whereby to provide a generally U-shaped structure for said lip portion and thereby a generally U-shaped opening at the lip end of said head.

2. The lacrosse stick head in accordance with claim 1 wherein said netting is configured to form a ball pocket, said lip portion defining said U-shaped opening generally aligned with said ball pocket and said throat portion.

3. The lacrosse stick head in accordance with claim 1 wherein said angle is about 41°.

4. The lacrosse stick head in accordance with claim 1 wherein said upper edge midpoint of said lip portion is removed from said side wall upper edge plane by about 0.67 inch.

* * * * *